US010070216B2

(12) United States Patent
Li

(10) Patent No.: US 10,070,216 B2
(45) Date of Patent: Sep. 4, 2018

(54) ACOUSTIC STRUCTURE WITH PASSIVE DIAPHRAGM

(71) Applicant: TGI Technology Private Limited, Singapore (SG)

(72) Inventor: Shihuang Li, Singapore (SG)

(73) Assignee: TGI TECHNOLOGY PRIVATE LIMITED, Singapore (SG)

( * ) Notice: Subject to any disclaimer, the term of this patent is extended or adjusted under 35 U.S.C. 154(b) by 0 days.

(21) Appl. No.: 15/122,056

(22) PCT Filed: Jan. 28, 2014

(86) PCT No.: PCT/SG2014/000036
§ 371 (c)(1),
(2) Date: Aug. 26, 2016

(87) PCT Pub. No.: WO2015/116000
PCT Pub. Date: Aug. 6, 2015

(65) Prior Publication Data

US 2017/0013352 A1 Jan. 12, 2017

(51) Int. Cl.
*H04R 1/28* (2006.01)
*H04R 1/32* (2006.01)
*H04R 9/06* (2006.01)

(52) U.S. Cl.
CPC ..... *H04R 1/2834* (2013.01); *H04R 1/283* (2013.01); *H04R 1/323* (2013.01); *H04R 1/2884* (2013.01); *H04R 9/06* (2013.01)

(58) Field of Classification Search
CPC .... H04R 1/2819; H04R 1/283; H04R 1/2834; H04R 1/2873; H04R 1/2888;
(Continued)

(56) References Cited

U.S. PATENT DOCUMENTS 6,367,579 B1 * 4/2002 Wiener ..... H04R 1/021 181/156
6,944,024 B1 * 9/2005 Devine, III ..... H04R 9/022 165/185
2008/0205682 A1 * 8/2008 Jenkins ..... H04R 1/2826 381/349

FOREIGN PATENT DOCUMENTS

JP 7-212883 A 8/1995
JP 2008-187464 A 8/2008
(Continued)

OTHER PUBLICATIONS

International Search Report issued in corresponding PCT Patent Appln Serial No. PCT/SG2014/000036 dated Mar. 11, 2014.

*Primary Examiner* — Joshua Kaufman
(74) *Attorney, Agent, or Firm* — Hayes Soloway PC

(57) ABSTRACT

This invention provides a kind of acoustic structure that uses passive diaphragm unit, it includes speaker unit, passive diaphragm unit, radiant tube; said passive diaphragm unit is located at the back of the cone of said speaker unit; the speaker unit has radiant tube on the sides; the said radiant tube end which is exposed in the air is located at the periphery of the cone of said speaker unit. It has the same orientation as the speaker unit; the said passive diaphragm unit vibrates when it is driven by the said speaker unit, the sound waves produced by the vibration of the said passive diaphragm unit are emitted by the radiant tube and radiant opening, and share the similar vocal point of the said speaker unit. With this, the sound effect of the full range sound is almost identical to the sound point sources, it also reduces the phase difference between the sound effects produced by the cone of speaker unit and the passive diaphragm unit, further enhanced the sound positioning feature. This invention also provides compact audio radiant module and
(Continued)

speaker box which are designed by the structural design above.

18 Claims, 9 Drawing Sheets

(58) Field of Classification Search
CPC ..... H04R 1/2896; H04R 1/021; H04R 1/025; H04R 1/028; H04R 2201/021; H04R 2400/11
See application file for complete search history.

(56) References Cited

FOREIGN PATENT DOCUMENTS

| | | | | | |
|---|---|---|---|---|---|
| JP | 2008205895 | A | * | 9/2008 | ..... H04R 1/02 |
| JP | 2013-102409 | A | | 5/2013 | |
| JP | 2013102409 | A | * | 5/2013 | |
| JP | 2013-143735 | A | | 7/2013 | |

* cited by examiner

ACOUSTIC STRUCTURE WITH PASSIVE DIAPHRAGM

This application claims priority to PCT application No. PCT/SG2014/000036, filed Jan. 28, 2014 entitled "Acoustic Structure with Passive Diaphragm".

TECHNICAL FIELD

This invention involves an acoustic structure design. Specifically, it involves an acoustic structure with passive diaphragm.

BACKGROUND TECHNOLOGY

When the loudspeaker unit is electromagnetically driven to vibrate, the low acoustic frequency is offset by the low frequency waves at the front and rear of the loudspeaker unit as its wavelength is longer than the dimension of the loudspeaker. Therefore, the low frequency wave at the rear of the loudspeaker has to be isolated (seal) or reflexed out. A common reflex method is through the use of reflex tubes or passive diaphragm. For structures that use passive diaphragms, the passive diaphragms are always placed on the side of the loudspeaker unit or casing. The passive diaphragms are driven to vibrate by the loudspeaker unit and generate sound waves. The flaw of this kind of structure is that the sound waves of the passive diaphragm and loudspeaker unit would have different resonation (retardation) based on the listening location, resulting in distortion, delay and inaccuracy in the sound field.

In addition, taking into account the characteristics of acoustic vibration, the frequency and wavelength of sound have brought about special requirements in the internal and external acoustic design of the speakers, including external dimensions, internal acoustic structure and materials. Therefore, there is always a unique threshold for speaker system design and the aesthetic of the exterior design is not the only consideration. For high performance electromagnetic speakers, there are a lot of restrictions on their speaker designs and they cannot be quickly adopted to the exterior design requirement of different application environments.

With the development in wireless technology, wireless playback (Bluetooth and Air Play) has become a mainstream playback method and the complication wire connection between traditional speakers and players are no longer required. Therefore, if the speakers can integrated into household items better and not just be a standalone feature in a home, the total area taken by the speakers will be reduce and the home will look clearer and sleeker. This requires a type of audio radiation module as a standard component that can be easily integrated into sealed chambers of household items, such as lamps and furniture. The module can lead to very diverse applications.

Invention Content

This invention primarily resolves the technical issues by providing an acoustic structure that uses a passive diaphragm that can be can help the passive diaphragm and loudspeaker achieve at almost the same vocal point to reduce acoustic retardation between the passive diaphragm and loudspeaker.

This invention also resolves the technical issues by providing an audio module and speaker that uses the said acoustic structure.

In order to resolve the said technical issues, this invention provides a type of acoustic structure with passive diaphragm that includes:

Loudspeaker Unit:

Passive diaphragm: the said passive diaphragm is located at the rear of the said loudspeaker unit. The said passive diaphragm is secured to the said casing through elastic rings.

A characteristic is that the side of the said loudspeaker unit is equipped with a radiant tube. One end of the said radiant tube is exposed to the air outside the cone of the said loudspeaker unit and aligned in the direction of the said loudspeaker unit. The said passive diaphragm is driven by the vibration caused by the said loudspeaker unit. The sound wave generated by the said passive diaphragm is emitted from the radiation outlet through the radiant tube to achieve almost the same vocal point as the said loudspeaker unit.

In a preferred embodiment, the said passive diaphragm and the said loudspeaker unit are located on the same axis.

In a preferred embodiment, there is at least one said passive diaphragm.

In a preferred embodiment, the dimensions of the said passive diaphragms are different.

In a preferred embodiment, the said radiant tube extends axially to the said radiation outlet and projection of the radiant tube on the surface of the cone opening will surround the cone opening.

In a preferred embodiment, the cross section of the radiant tube is a "C" shape that is not connected on both ends.

In a preferred embodiment, the directions of the said elastic rings are the same.

In a preferred embodiment, the said radiant tube consists of a structure which has its cross sectional area gradually increases from the connection with the said radiation chamber to the connection with the said radiation outlet.

A type of compact audio radiation module made with the said acoustic structure that uses a passive diaphragm includes:

Ring-Shape Casing:

Loud speaker unit: the said loudspeaker unit is installed inside the said ring-shaped casing and the cone of the said loudspeaker unit is connected to the said ring-shaped casing and exposed to the air.

There is a radiation outlet on one side of the connection between the cone of the said loudspeaker unit and the said ring-shaped casing.

The said radiation outlet is located on the peripheral surface of the cone of the said loudspeaker.

Passive diaphragm: the said passive diaphragm is located at the rear of the said loudspeaker unit. The said passive diaphragm is secured to the said casing through elastic rings.

A characteristic is that the side of the said loudspeaker unit is equipped with a radiant tube. One end of the said radiant tube is exposed to the air outside the cone of the said loudspeaker unit and aligned in the direction of the said loudspeaker unit. The said passive diaphragm is driven by the vibration caused by the said loudspeaker unit. The sound wave generated by the said passive diaphragm is emitted from the radiation outlet through the radiant tube to achieve almost the same vocal point as the said loudspeaker unit.

In a preferred embodiment, the said compact audio radiation module includes a circuit board.

In a preferred embodiment, the said circuit board can be installed in the said radiation chamber.

A speaker made using the said compact audio radiation module includes the casing, compact audio radiation module and sealing component.

In a preferred embodiment, the casing features a one-piece structure.

In a preferred embodiment, the length of the said sealing components is equal to the geometric perimeter of the contact area between the said casing surface and the said compact audio radiation module.

In a preferred embodiment, the said casing only need to factor in the holes required for the fixation of the said audio radiation module and does not need to have an acoustic structural design.

In a preferred embodiment, the said casing features an inflatable structure.

In a preferred embodiment, the said casing can be replaced.

A type of speaker made with the said acoustic structure with passive diaphragm includes:

Casing:

Loud speaker unit: the said loudspeaker unit is installed inside the said ring-shaped casing and the cone of the said loudspeaker unit is connected to the said ring-shaped casing and exposed to the air.

There is a radiation outlet on one side of the connection between the cone of the said loudspeaker unit and the said casing.

The said radiation outlet is located on the peripheral surface of the cone of the said loudspeaker.

Passive diaphragm: the said passive diaphragm is located at the rear of the said loudspeaker unit. The said passive diaphragm is secured to the said casing through elastic rings.

A characteristic is that the side of the said loudspeaker unit is equipped with a radiant tube. One end of the said radiant tube is exposed to the air outside the cone of the said loudspeaker unit and aligned in the direction of the said loudspeaker unit. The said passive diaphragm is driven by the vibration caused by the said loudspeaker unit. The sound wave generated by the said passive diaphragm is emitted from the radiation outlet through the radiant tube to achieve almost the same vocal point as the said loudspeaker unit.

This invention discloses a kind of acoustic structure that uses a passive diaphragm that includes a loudspeaker unit, a passive diaphragm and a radiant tube. The said passive diaphragm is located at the rear of the said loudspeaker unit. The side of the said loudspeaker unit is equipped with a radiant tube. One end of the said radiant tube is exposed to the air outside the cone of the said loudspeaker unit and aligned in the direction of the said loudspeaker unit. The said passive diaphragm is driven by the vibration caused by the said loudspeaker unit. The sound wave generated by the said passive diaphragm is emitted from the radiation outlet through the radiant tube to achieve almost the same vocal point as the said loudspeaker unit, achieving a full range sound effect similar to that of a point source. This reduces the deviation between the sound generated by the cone of the said loudspeaker unit and that generated by the said passive diaphragm, and drastically enhances sound localisation.

This invention provides a type of compact audio radiation module where the vocal of the passive diaphragm and the cone of the loudspeaker unit occur at the same point, and as a result, the advantages of the speaker can be utilised in sound reducing fields and phases. Through the use of a layered passive diaphragm, the effective area of the passive diaphragm is increased by multiple times and the passive diaphragm will have the capacity to produce good bass performance. Through the layered positioning of the loudspeaker unit and passive diaphragm, the surface area of the audio radiation module is reduced, which provides benefits for the exterior design of the speaker. At the same time, through the layered positioning of the loudspeaker unit and passive diaphragms and due to the different in dimensions of the passive diaphragms, the intensity of the vibration generated by the loudspeaker unit that is received by each passive diaphragm is different. This ensures that while the passive diaphragms mutually offset out each other's vibration vectors, part of the vibration of the loudspeaker unit is offset as well, reducing the overall vibration generated by the compact audio radiation module. This limits the vibration of the entire module at high dynamism, reduces sound colouration, ensures sound quality and further reduces the design requirements of the external box. At the same time, the compact audio radiation module made with passive diaphragms has very low requirement on the volume of the casing and will not cause great differences in sound quality when a casing of different volume is used. This ensures good adaptability.

This invention provides a type of speaker made using the said compact audio radiation module. As a one piece casing is used, the only the connection between the said casing and the said compact audio radiation module needs to be sealed. Compared to current speaker products, the sealing perimeter has been drastically reduced, which significantly lowered the requirement on sealing technology during production and assembly, and significantly increases the yield. In addition, as the casing design does not need to take into consideration of electronic and acoustic issues, designers from any industry and field can design the most suitable applications based on their respective requirements. It also offers the possibility of integration the speaker into existing products. This provides great diversity in application and facilitates secluded placement of the speaker that does not affect the appearance of the existing products. At the same time, as the said compact audio radiation module uses a passive diaphragm structure, the requirement of the said compact audio radiation module on the casing is very low. This makes it possible to replace the casing and allows consumer to DIY personalised speakers based on their preferences.

DESCRIPTION OF ATTACHED DIAGRAMS

FIG. 5 is the schematic diagram for embodiment 4 of this invention, of which:

(a) is the configuration diagram (b) is the appearance diagram

Figure 6:
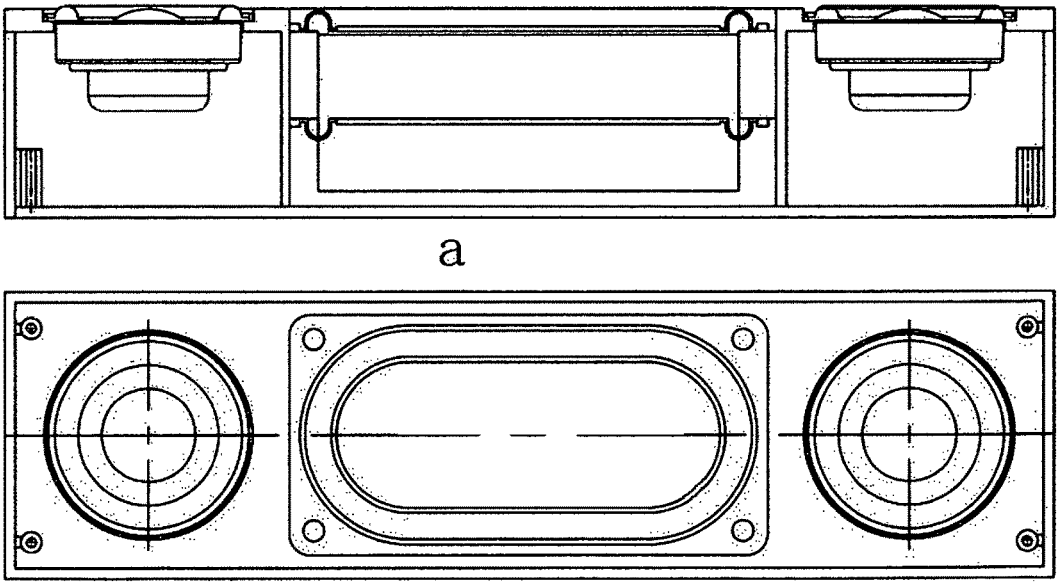

FIG. 6 is the schematic diagram for existing speaker in embodiment 4 of this invention, of which:

(a) is the configuration diagram (b) is the appearance diagram

Figure 7:
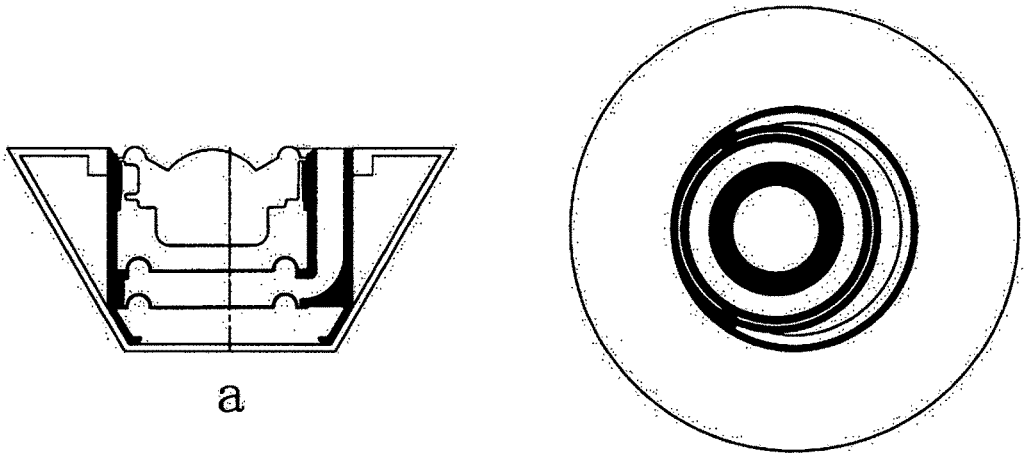

FIG. 7 is the schematic diagram for mono-channel speaker of embodiment 5 of this invention, of which:

(a) is the configuration diagram (b) is the appearance diagram

Figure 8:
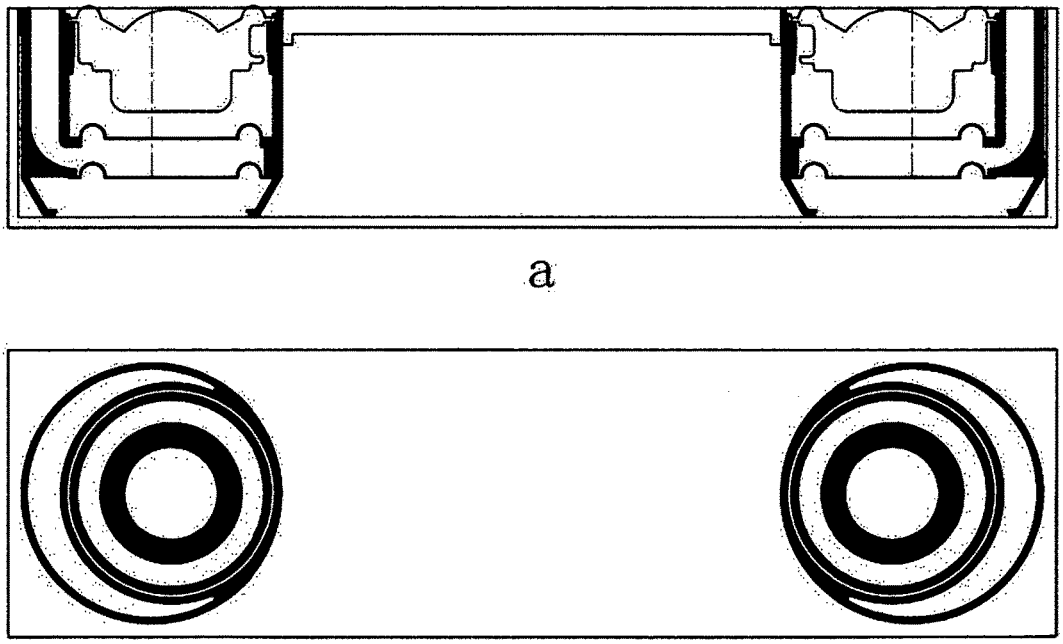

FIG. 8 is the schematic diagram for the dual-channel speaker of embodiment 5 of this invention, of which:

(a) is the configuration diagram (b) is the appearance diagram

Figure 9:
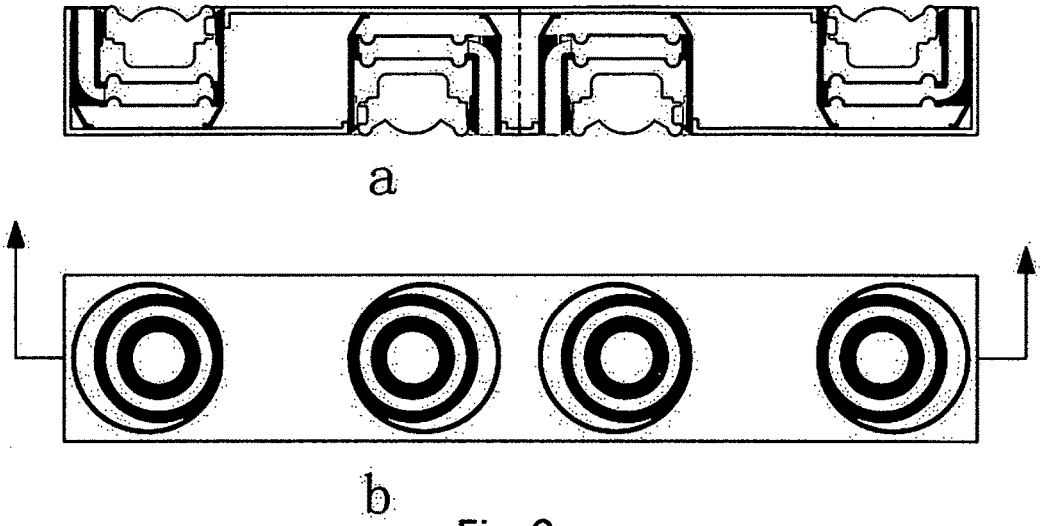

FIG. 9 is the schematic diagram for the multi-channel speaker of embodiment 5 of this invention, of which:

(a) is the configuration diagram (b) is the appearance diagram

Figure 10:
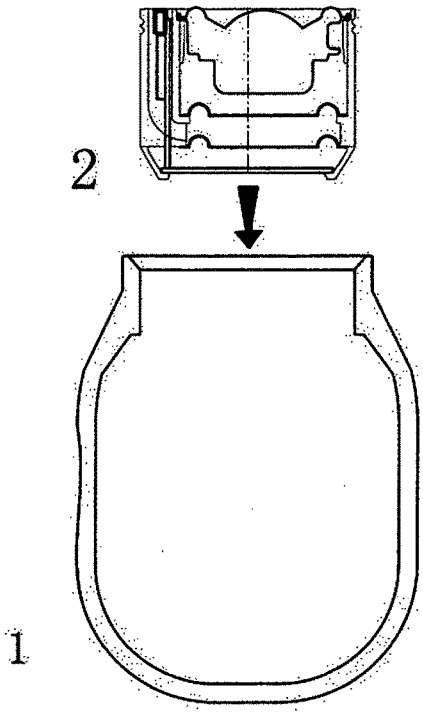
Figure 11:
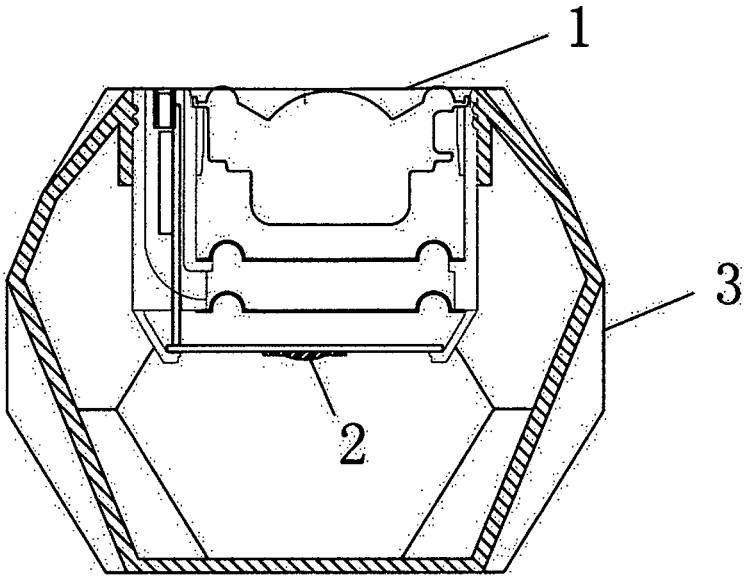
Figure 12:
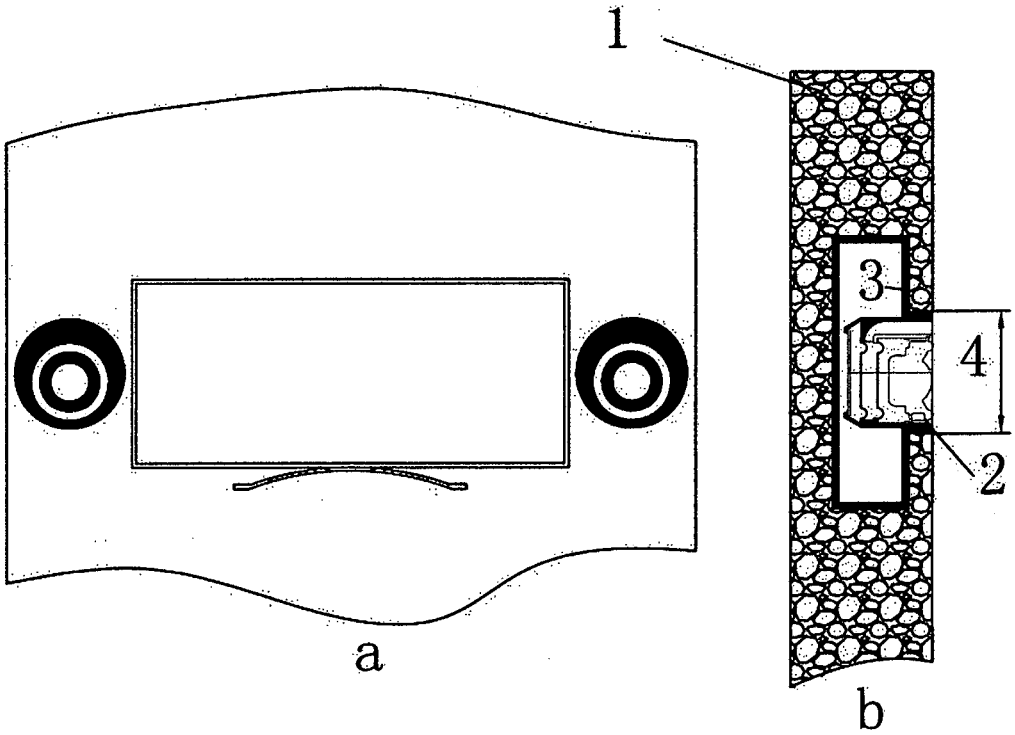

FIG. 10 is the schematic diagram for embodiment 6 of this invention;

FIG. 11 is the schematic diagram for embodiment 7 of this invention;

FIG. 12 is the schematic diagram for embodiment 8 of this invention, of which:

(a) is the rendering (b) is the assembled structure diagram

Figure 13:
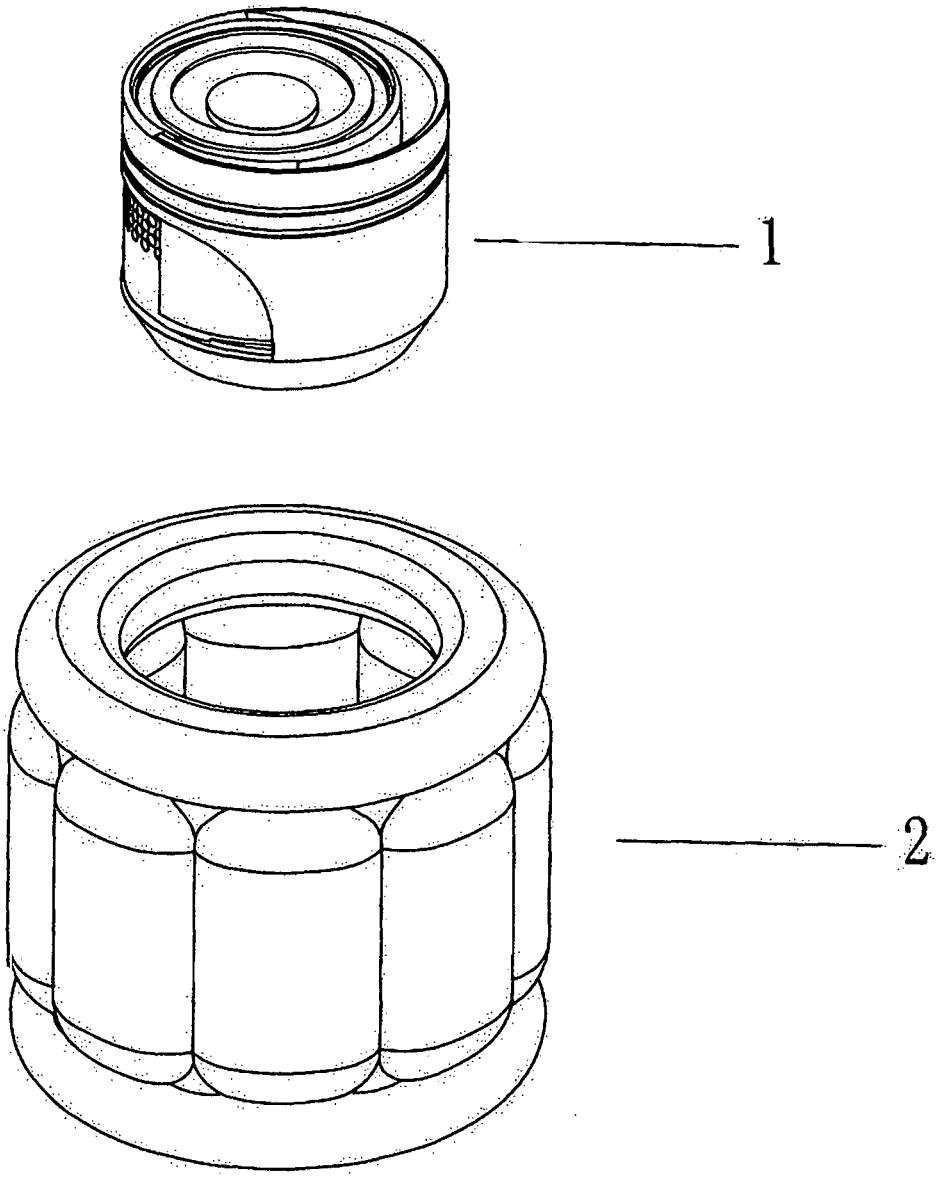

FIG. 13 is the schematic diagram for embodiment 9 of this invention.

Figure 14:
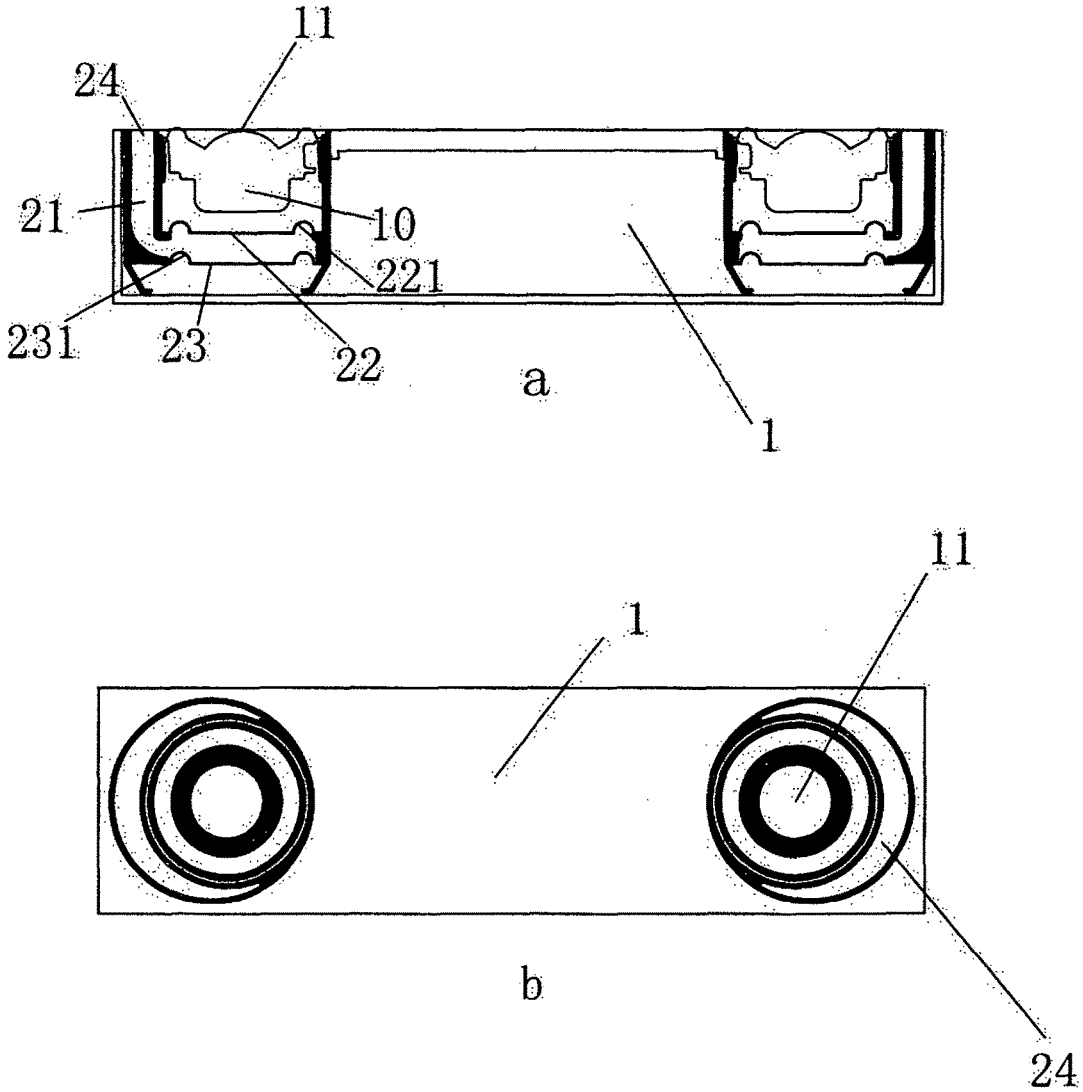

FIG. 14 is the schematic diagram for embodiment 10 of this invention, of which:

(a) is the configuration diagram (b) is the appearance diagram

DESCRIPTION OF PREFERRED EMBODIMENTS

The following embodiments together with the diagrams provide further description for the inventions:

Embodiment 1

Figure 1:
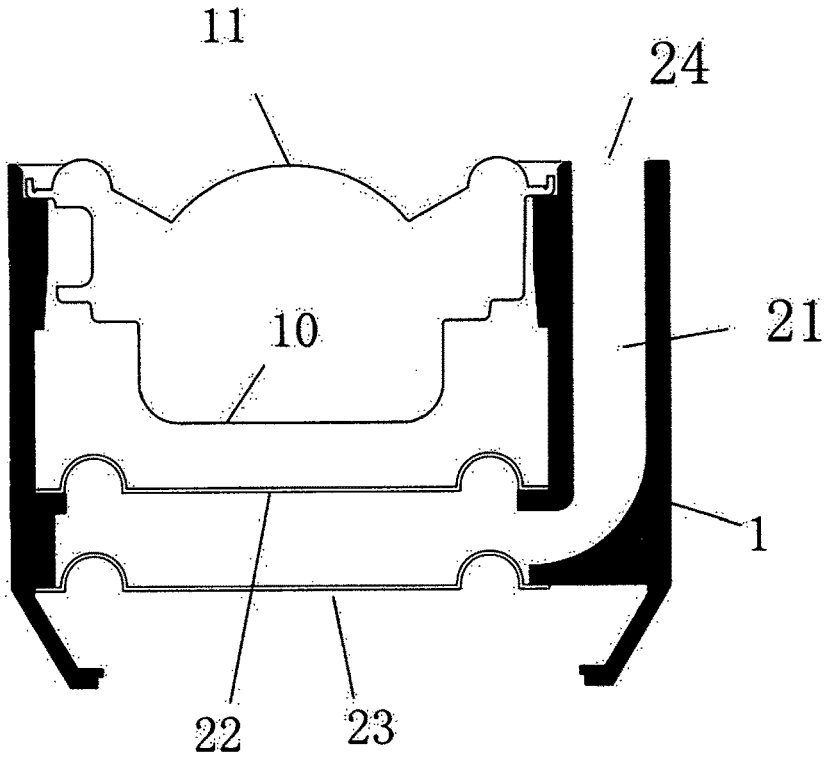
FIG. 1 is the structural diagram for embodiment 1 of this invention.

As per FIG. 1, this embodiment provides a type of audio radiation module that includes a ring-shaped casing 1 and a loudspeaker unit 10. The said loudspeaker unit 10 is installed inside the said ring-shaped casing 1 and the cone 11 of the said loudspeaker unit 10 is connected to the said ring-shaped casing 1 and exposed to the air. There is a radiation outlet 24 on one side of the connection between the cone 11 of the said loudspeaker unit 10 and the said ring-shaped casing 1. The said radiation outlet 24 is located on the peripheral surface of the cone 11 of the said loudspeaker 10. Passive diaphragms 22 and 23: the said passive diaphragms 22 and 23 are located at the rear end of the said loudspeaker unit 10 and is located on the same axis as loudspeaker unit 10. The said passive diaphragms 22 and 23 are secured to the said casing 1 through elastic rings 221 and 231. The side of the said loudspeaker unit 10 is equipped with a radiant tube 21. One end of the said radiant tube 21 is connected to radiation outlet 24 and aligned in the direction of the said loudspeaker unit 10.

During actual operation, loudspeaker unit 10 will be initiated electromagnetically to generate sound. Cone 11 will vibrate and the radiation caused by the vibration will be emitted in front of cone 11. At the rear end of cone 11, passive diaphragms 22 and 23 will be initiated by the airflow and start vibrating.

The sound waves created through the vibration of passive diaphragms 22 and 23 will be transmitted through radiant tube 21 and emitted from radiation outlet 24. This means that passive diaphragm 22 and 23, as well as cone 11 of loudspeaker unit 10, have the same vocal point, which can utilise the advantages of loudspeaker unit 10 to great effects in sound reducing fields and phases, especially at bass frequencies.

The embodiment has the following characteristics:

The said passive diaphragms 22 and 23 in the embodiment are located at the rear end of loudspeaker unit 10. The layered design of the structure gives the entire device very good bass compensation as the entire module is located within the radius of cone 11. Using the two layer passive diaphragm design, the surface area of the passive diaphragms are several times that of cone 11, which means that the total surface area of the "loudspeaker cone and passive diaphragms" is at least twice that of cone 11. It helps in achieving better bass performance and reduces the surface area of the sounding body, which is good for the exterior design of the speaker. In particular, the dimensions of passive diaphragm 22 and 23 can be designed to be different so that the intensity of the vibration passive diaphragm 22 and 23 received by loudspeaker unit 10 will be different. While passive diaphragm 22 and 23 mutually offset out each other's vibration vectors, part of the vibration of loudspeaker unit 10 is offset as well, reducing the overall vibration generated by the compact audio radiation module. This limits the vibration of the entire module at high dynamism, reduces sound colouration and ensures sound quality. At the same time, the compact audio radiation module made with passive diaphragms has very low requirement on the volume of the casing and will not cause great differences in sound quality when a casing of different volume is used. This ensures good adaptability.

In the embodiment, radiant tube 21 extends axially to the radiation outlet 24. The cross sectional projection of radiant tube 21 on the surface of cone 11 opening will surround the cone 11 opening. This structure fully reduces the cross sectional area of radiant tube 21 and is very useful for the one piece design of casing 1. It further enhanced the advantage of compactness.

Embodiment 2

Figure 2:
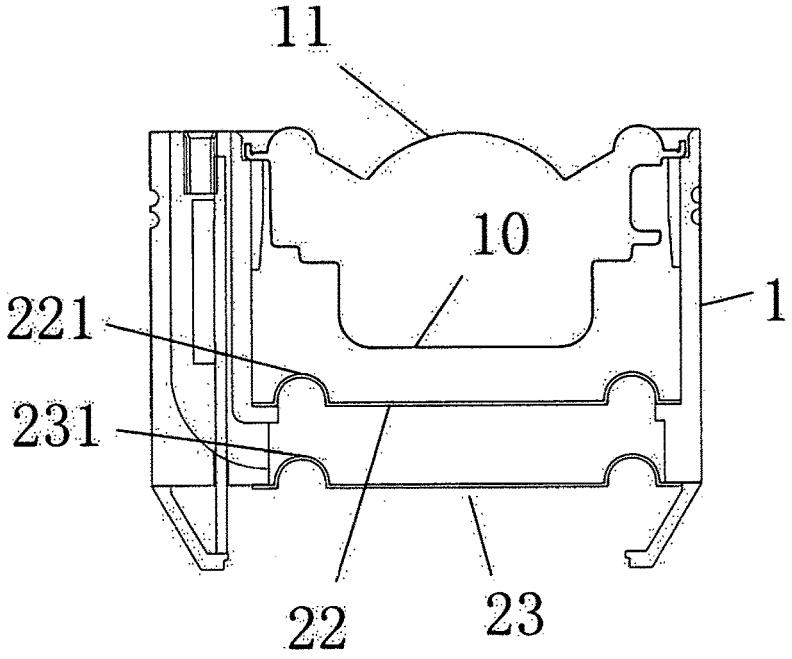
FIG. 2 is the structural diagram for embodiment 2 of this invention.
Figure 3:
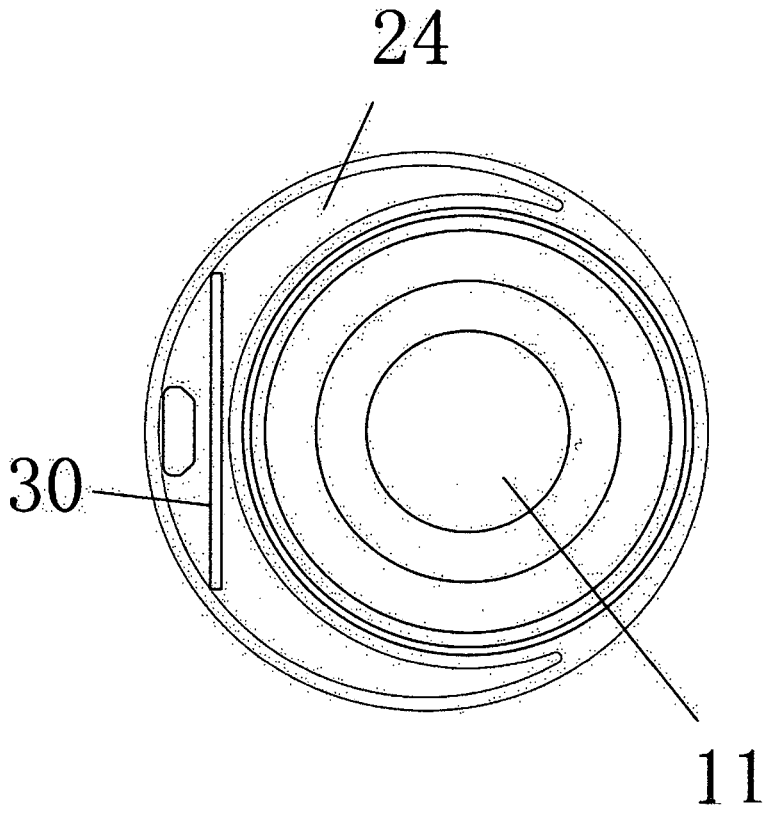
FIG. 3 is the top view of embodiment 2 of this invention.

As per FIGS. 2 and 3, the structure of this embodiment is similar to that of embodiment 1. The difference is that in this solution, the cross section of radiant tube 21 is in a "C" shape and covers the surface of the cross sectional area of cone 11. This helps to conceal circuit board 30 at the side of loudspeaker unit 10. Various active module solutions can be created based on this embodiment, including amplifier and divider.

In the embodiment, passive diaphragm 22 and 23 are connected to ring-shaped casing 1 through elastic ring in the same direction. As per FIG. 8, the direction of elastic ring 221 and 231 is the same. In actual fact, the elasticity of elastic ring 221 or 231 is uneven upstream or downstream of elastic ring 22 or 23. The structures means that whether it is expansion or contraction, the elasticity vector of radiation chamber 20 will remain the same and causes the radiation amplitude to have the same characteristic in both positive and negative half-cycles. This prevent losses caused by differences in elasticity between the positive and negative sides of radiation unit 22 or 23.

Embodiment 3

Figure 4:
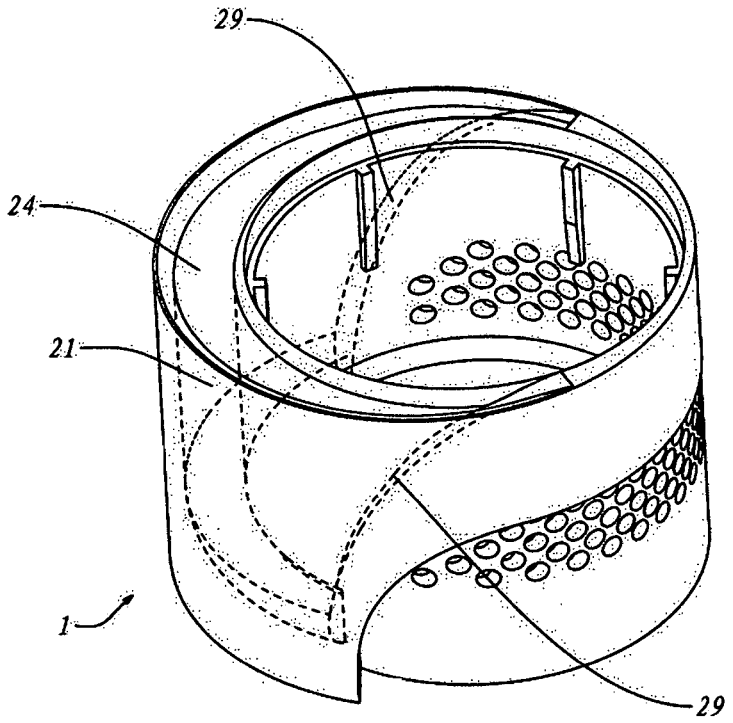
FIG. 4 is the perspective schematic diagram for embodiment 3 of this invention.

As per FIG. 4, the perspective schematic diagram for the casing of embodiment 2 is shown.

The structure of the embodiment is similar to embodiment 1 and the difference is that in embodiment 2, the cross-sectional area of radiant tube 21 is unchanged and it has consistent diameter. In this embodiment, radiant tube 21 has expanding edge 29 as it extends from the radiation chamber to outlet 24. The tube has a gradually expanding design. Radiant tube 21 in the design has the characteristic of small sound resistance and at the same time, can amplify the sound waves it has collected, which will further enhance the vocal performance of the entire module.

Embodiment 4

Figure 5:
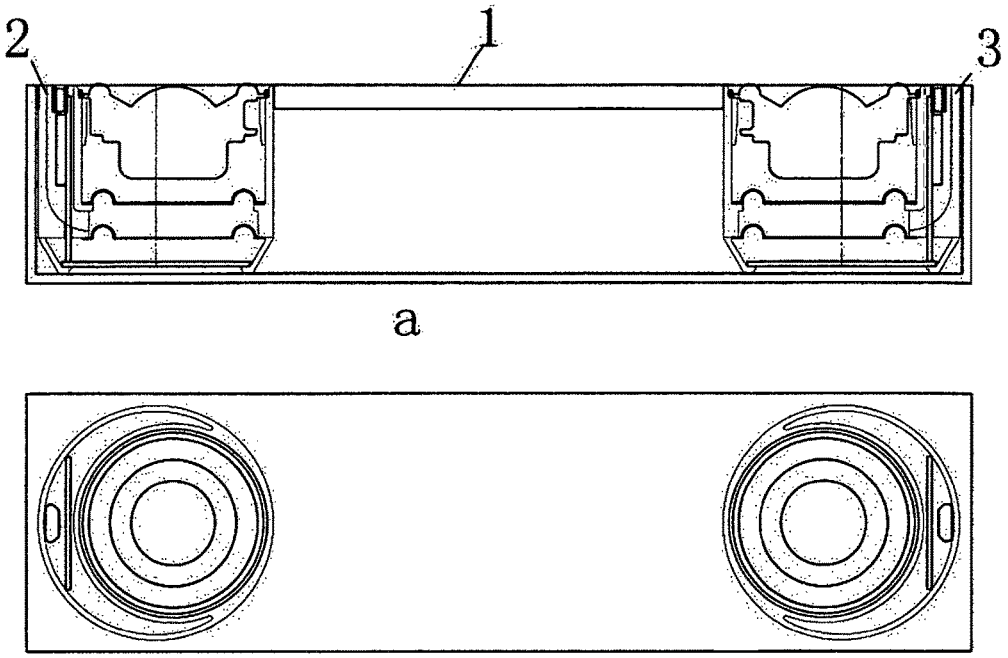

As per FIG. 5, the schematic diagram for embodiment 4 of this invention is shown. The embodiment is a speaker made using the said compact audio radiation module that includes one piece casing 1 and compact audio radiation module 2 and 3. During assembly, as the casing is a one piece design, only the connection points between the casing surface and the compact radiation modules have to be sealed. This required length of the sealing component is the sum of the surface perimeter of compact audio radiation module 2 and 3. The surface of the said compact audio radiation module 2 and 3 are circular in shape with a diameter of 50 mm. Therefore, the required length of the sealing component is: 2×3.14×50=314 mm.

Taking reference from FIG. 6, which is the schematic diagram for traditional speaker, for a traditional speaker of similar dimensions, the loudspeaker unit and passive diaphragm as placed separated as the casing is divided into the back cover and the front plate. Therefore, while sealing, the loudspeaker unit and passive diaphragm have to be sealed to the front plate before sealing the front plate to the back cover. The length of sealing component required is up to 2,008 mm.

Therefore, it is apparent that the speaker made using the compact audio radiation module can drastically reduce the length of sealing component required and simplify the sealing process required during the assembly of the speaker, which will lead to better yield.

Embodiment 5

As per FIGS. 7, 8 and 9, the schematic diagram for embodiment 5 is shown.

The embodiment can use one, two or four compact audio radiation modules to create the speaker. Speaker made using one compact audio radiation module is a mono-channel speaker; speaker made using two compact audio radiation modules is a dual-channel speaker; while speaker made using four compact audio radiation modules is a multi-channel speaker. From mono-channel to multi-channel speakers, only the size of the casing and the number of audio radiation modules used have to be adjusted. The casing does not need to be designed and changed according to acoustic considerations. From this, it is apparent that the use of the compact audio radiation modules can eliminate the need of acoustic consideration during the design of the speaker casing and as a result, lower the threshold for speaker structure and casing design to the minimum.

Embodiment 6

As per FIG. 10, the schematic diagram for embodiment 6 of the invention is shown.

The embodiment is a speaker made using the said compact audio radiation module that includes glass casing 1 and compact audio radiation module 2. As during the blowing process, the class has excellent sealing for all other parts other than the opening, a compact audio radiation module of suitable dimension can be inserted into it to make a good speaker. Therefore, using the compact audio radiation module to make speakers can enable diversity in casing material options and help create speakers with personalised exterior designs.

Embodiment 7

As per FIG. 11, the schematic diagram for embodiment 8 of the invention is shown.

The embodiment is a speaker made using the said compact audio radiation module with compact audio radiation module 1 installed inside lampshade 3. The bottom of the said compact audio radiation module 1 has LED light 2 installed on it. Lampshade 1 is used as a casing to provide good integration of the speaker with the lamp. From this, it is apparent that the use of the compact audio radiation module means that speakers no longer need to be independent components in home, but can be very well integrated into home furnishing to save space and create more diverse applications.

Embodiment 8

As per FIG. 12, the schematic diagram for embodiment 8 of the invention is shown.

The embodiment is a speaker made using the said compact audio radiation module with compact audio radiation module 2 installed on TV backdrop 1. During renovation, chamber 3 and hole 4 are created on the backdrop and by simply placing compact audio radiation module 2 into hole 4 securely in the backdrop, compact audio radiation module 2 and chamber 3 will become a speaker.

Embodiment 9

As per FIG. 13, the schematic diagram for embodiment 9 of the invention is shown.

The embodiment is a speaker made using the said compact audio radiation module with compact audio radiation module 2 installed on inflatable casing 2 to create an inflatable and deflatable speaker. As an inflatable structure is used, casing 2 has to be inflatable for the speaker to work. While the speaker is not in used, casing 2 can be deflated to save space. This provides advantages over the dimensions of the speaker. At the same time, compact audio radiation module 2 can also be integrated perfectly into other inflatable products to create multi-functional speakers, such as integration with inflatable pillows and mattresses. This further enhance the application scope of the compact audio radiation module.

Embodiment 10

As per FIG. 14, this embodiment provides a type of speaker that includes a one piece casing 1 and 2 loudspeaker unit 10. Taking on of the said loudspeaker unit 10 for example, the said passive diaphragms 22 and 23 are located at the rear end of the said loudspeaker unit 10. When in use the said passive diaphragms 22 and 23 will be driven by airflow generated by cone 11 to achieve the objective of radiation. The said passive diaphragms 22 and 23 are secured to the said casing 1 through elastic rings 221 and 231.

The side of the said loudspeaker unit 10 is equipped with a radiant tube 21 with one side connected to radiation outlet 24. Of which, the said passive diaphragm 22 and 23 are located at the rear end of cone 11 of loudspeaker unit 10 and the radiation outlet 24 is located on the edge of cone 11. The passive diaphragm 22 and 23 are aligned in the same direction as cone 11. The said radiant tube 21 extends axially to the said radiation outlet 24. The cross sectional projection of radiant tube 21 on the surface of the cone opening will surround the cone opening, forming a "C" shape.

The description above only covers the preferred embodiments of this invention and it is not meant to limit its implementation scope i.e. any equivalent changes or modifications made within the patent scope of this invention or based on its specification content should all fall within the scope of this invention.

The invention claimed is:

1. An acoustic structure that uses passive diaphragm unit, comprises:

a speaker unit;

a passive diaphragm unit, said passive diaphragm unit comprising a pair of diaphragms substantially in parallel located at a back of the speaker unit;

the speaker unit comprising: a cone; at least one radiant tube on a side of the speaker unit, the radiant tube having a cross section, the radiant tube and a radiant outlet are connected and have the same orientation as the speaker unit, the radiant outlet exposed in the air is located at a periphery of the cone; the passive diaphragm unit capable of vibrating when it is driven by the speaker unit, wherein sound waves produced by the vibration of the passive diaphragm unit are emitted by the radiant tube and radiant outlet, and share a similar vocal point of the speaker unit, wherein a first diaphragm of the pair of diaphragms is isolated from the speaker unit by the radiant tube and a second diaphragm of the pair of diaphragms and the first diaphragm is disposed between the second diaphragm and a substantially open back of the speaker unit.

2. According to the acoustic structure in claim 1, wherein said passive diaphragm unit and said speaker unit are placed in a coaxial position.

3. According to the acoustic structure in claim 1, wherein a plurality of elements form the passive diaphragm unit.

4. According to the acoustic structure in claim 3 wherein the dimension of said passive diaphragm unit elements are not identical.

5. According to the acoustic structure in claim 1, wherein said radiant tube extends in an axial direction and connects to said radiant outlet; and a projection of the cross section of the radiant tube at a cone opening surface surrounds the cone opening.

6. According to the acoustic structure in claim 1, wherein the cross section of radiant tube is in a 'C shape where a beginning and end part are not connected.

7. According to the acoustic structure in claim 1, wherein a orientation of an elastic ring is the same as the acoustic structure.

8. According to the acoustic structure in claim 1, wherein the cross sectional area of the radiant tube in increasing from an end of said radiant tube to a connecting part of said radiant outlet.

9. A compact audio radiant module, comprising:

a ring-shaped housing;

a speaker unit, said speaker unit installed in the ring-shaped housing; a cone of the speaker unit connected to the ring-shaped housing and exposed in the air;

a radiant outlet where the ring-shaped housing is connected to the cone of the speaker unit, wherein the radiant outlet is located at a periphery of the cone of said speaker unit;

a passive diaphragm unit; said passive diaphragm unit comprising a pair of diaphragms substantially in parallel is located at a back of the speaker unit; the passive diaphragm unit connected to the ring-shaped housing with an elastic ring;

wherein said speaker unit has at least one radiant tube on a side of the speaker unit; the radiant tube connected between the radiant outlet and a gap between the diaphragms;

wherein the radiant tube has the same orientation as the speaker unit; the passive diaphragm unit is capable of vibrating when driven by the speaker unit, wherein sound waves produced between the diaphragms by vibration of the passive diaphragm unit are emitted by the radiant tube and radiant outlet, and share a vocal point with the speaker unit, wherein at least one of the diaphragms is isolated from the speaker unit by the radiant tube and the gap between the diaphragms and the first diaphragm is disposed between the second diaphragm and a substantially open back of the speaker unit.

10. The compact audio radiant module in claim 9, wherein said compact audio radiant module includes a circuit board.

11. The compact audio radiant module in claim 10, wherein said circuit board is in the radiant tube.

12. A speaker manufactured according to the compact audio radiant module in claim 9, comprising: a speaker box, the compact audio radiant module, and at least one sealing part; the speaker box having at least one hole to receive said compact audio radiant module, wherein the at least one sealing part is installed between each of the at least one hole and the compact audio radiant module.

13. The speaker in claim 12, wherein the speaker box has a one-piece structure.

14. The speaker in claim 12, wherein a length of the sealing parts is a geometric perimeter where a surface of said speaker box touches the compact audio radiant module.

15. The speaker in claim 12, wherein the only acoustic feature of said speaker box is the at least one hole to receive the compact audio radiant module.

16. The speaker in claim 12, wherein said speaker has an inflatable structure.

17. The speaker in claim 12, wherein said speaker is replaceable.

18. A speaker comprising:

a speaker box;

a speaker unit, said speaker unit installed in the speaker box; a cone of the speaker unit is connected to the speaker unit and exposed in the air;

a radiant outlet on a surface where the speaker unit is connected to the cone of the speaker unit;

the radiant outlet located at a periphery of the cone of said speaker unit;

a passive diaphragm unit; said passive diaphragm unit comprising a pair of diaphragms substantially in parallel located at a back of the speaker unit; the passive diaphragm unit connected to the speaker box with an elastic ring;

wherein said speaker unit has a radiant tube on a side, the radiant tube providing an air passage from a gap between the diaphragms to the radiant outlet, wherein the radiant tube has the same orientation as the speaker unit; the passive diaphragm unit capable of vibrating when driven by the speaker unit, whereby sound waves produced by the vibration of the passive diaphragm unit are emitted by the radiant tube and radiant outlet, and share a similar vocal point with the speaker unit, wherein a first diaphragm of the pair of diaphragms is isolated from the speaker unit by the radiant tube and a second diaphragm of the pair of diaphragms and the first diaphragm is disposed between the second diaphragm and a substantially open back of the speaker unit.

* * * * *